US008920897B2

(12) United States Patent
Snyder

(10) Patent No.: US 8,920,897 B2
(45) Date of Patent: Dec. 30, 2014

(54) HEAT EXCHANGER PRESSURE TEST SHIELD

(75) Inventor: Keith W. Snyder, Neskowin, OR (US)

(73) Assignee: Keith W. Snyder, Sweet Home, OR (US)

( * ) Notice: Subject to any disclaimer, the term of this patent is extended or adjusted under 35 U.S.C. 154(b) by 434 days.

(21) Appl. No.: 13/543,187

(22) Filed: Jul. 6, 2012

(65) Prior Publication Data

US 2014/0008045 A1 Jan. 9, 2014

(51) Int. Cl.
*F28F 7/00* (2006.01)

(52) U.S. Cl.
USPC ..... 428/66.6; 52/764; 52/780; 109/49.5; 165/134.1; 428/64.1

(58) Field of Classification Search
USPC ..... 428/66.6, 64.1; 52/764, 780; 109/49.5; 165/134.1
See application file for complete search history.

(56) References Cited

U.S. PATENT DOCUMENTS 6,401,427 B1 * 6/2002 Snyder ..... 52/764

* cited by examiner

*Primary Examiner* — Brent O'Hern

(57) ABSTRACT

Disclosed is a heat exchanger pressure test shield to protect observers from a shell and tube heat exchanger plug ejection during a hydrostatic pressure test. The shield provides a transparent high impact resistant shield material clamped between two annular rings. This shield material is isolated from the annular rings by a flexible gasket, which allows slight movement of the shield material upon impact, which is necessary to prevent failure. The heat exchanger pressure test shield is mounted to the channel cover flange, after removal of the channel cover, with several studs passing through an adjustable slot, enabling attachment to a range of heat exchanger diameter sizes. The heat exchanger pressure test shield, with adjustable slot attachment, enables visual inspection of tube plugs during pressure testing at a lower cost, while significantly improving the safety of the observer.

20 Claims, 2 Drawing Sheets

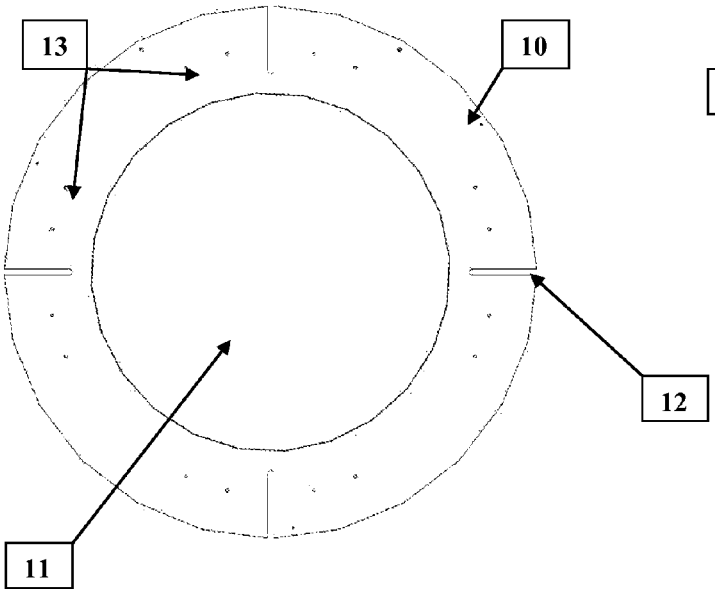
FIG. 1 – FRONT VIEW
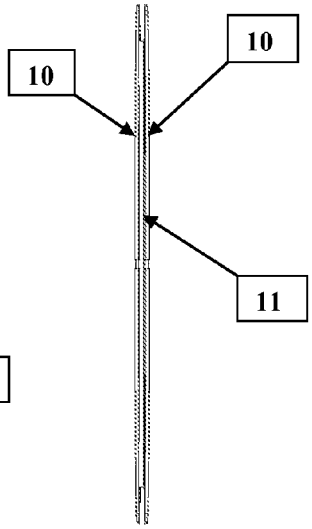
FIG. 2 – SIDE VIEW
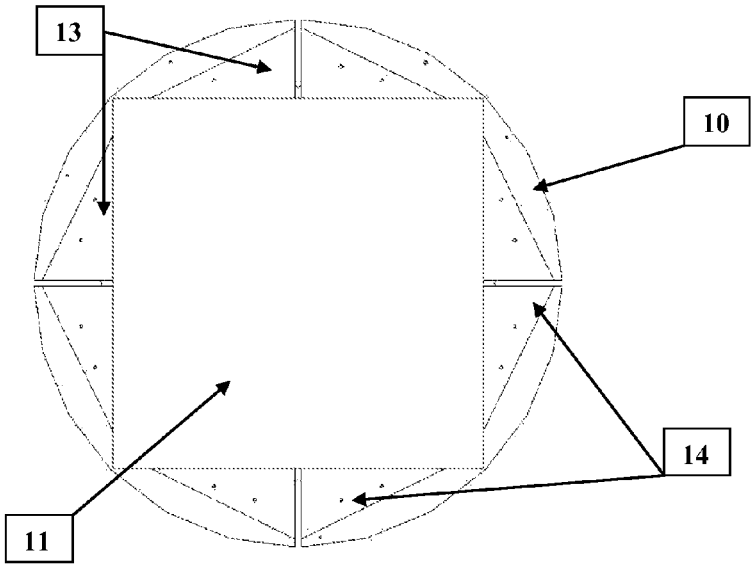
FIG. 3 – FRONT VIEW
FRONT ANNULAR RING REMOVED (LARGE DIAMETER SHIELDS)

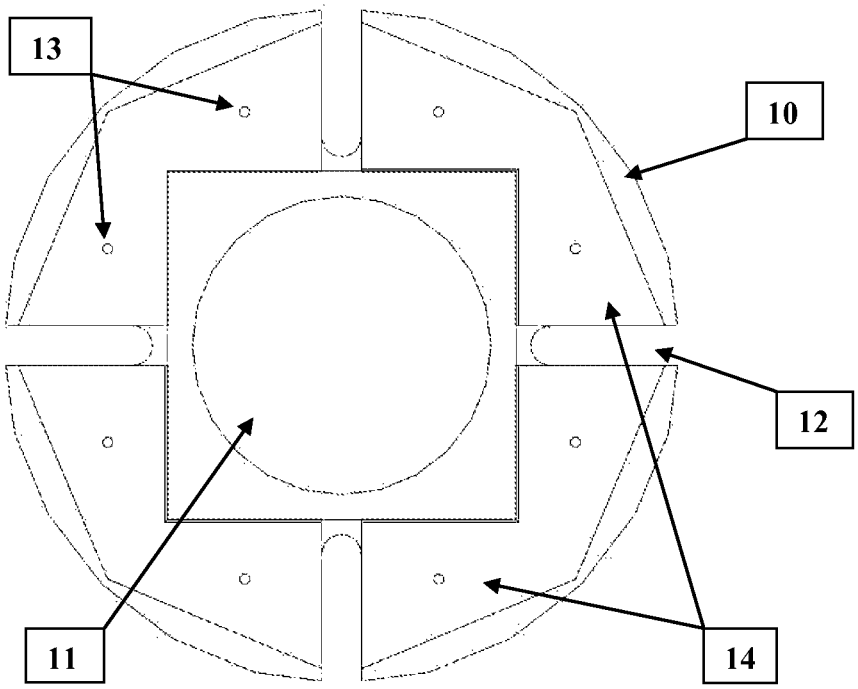
FIG. 4 – FRONT VIEW
TOP ANNULAR RING REMOVED (SMALL DIAMETER SHIELDS)

HEAT EXCHANGER PRESSURE TEST SHIELD

BACKGROUND OF THE INVENTION

1. Field of the Invention

The present invention relates to shielding workers from a tube plug ejection, during hydrostatic pressure testing of shell-and-tube heat exchangers. It replaces the channel cover during testing to allow observance of tube plugs to check for leakage.

2. Description of the Prior Art

The tubes in a Shell-and-Tube heat exchanger can corrode over time, allowing for the undesired mixing of fluids. When a tube corrodes enough to fail, the tube is plugged with a tapered metal plug, commonly referred to as a tube plug. These tube plugs are inserted into both ends of the tube at the tubesheet, which eliminates the use of that tube, but allows continued operation of the heat exchanger without the mixing of fluids. Following tube plugging, a hydrotest, or hydrostatic pressure test, of the exchanger shell side is usually conducted with the channel cover removed so that leaks can be detected on the tube side face of the stationary tube sheet. To detect leaks, a worker usually observes the tube sheet face for fluid leakage around the plug. In industry, there have been instances in which a tube plug in the stationary tube sheet became dislodged while under shell side pressure, ejecting the plug at a high velocity towards the observer. Typically a worker will position themselves behind a sheet of plywood or wire mesh, and peer around the edge to observe the tube sheet. This practice is unsafe, as these materials do not provide adequate protection in case of plug ejection. Without a standard, and proven safe shield, workers must rig some temporary shielding, including but not limited to the above mentioned materials, which can prove to be time consuming and inadequately supported. And, since the heat exchangers are usually used outdoors in a large industrial facility, they are not always easy to access for rigged temporary shielding, as they may be located in stacks extending high off the ground, with limited accessibility. An idea for an innovative, proven shield, which could be attached to the end of these heat exchangers during testing, was needed.

U.S. Pat. No. 6,401,427 discloses a modular system for containing projectiles, which has a sheet of material including at least a polycarbonate layer held by a metal frame having a straight frame member corresponding to each straight edge of the sheet. Each frame member has a U-shaped shield channel covering and holding a straight edge of the sheet and an adjacent U-shaped clamp channel rigidly held against the shield channel. A flexible gasket separates each sheet edge from its respective shield channel; and each frame member is fastened to each adjacent frame member only by clamps extending between adjacent clamp channels.

This system is limited to rectangular shielding and cannot be attached to the end of a heat exchanger efficiently. It, as with other shield materials, would need to be rigged in place, with a temporary support structure that would need to be modified depending on the location and installation specifics of the heat exchanger undergoing testing.

Polycarbonate and polycarbonate laminates are fabricated and used as impact resistant transparent barriers. There has been limited testing, with most tests occurring in the ballistic range of velocities of 1000-3000 ft/s. Manufacturer's data on impact resistance certifies polycarbonate materials in terms of Underwriters Laboratories (UL) or National Institute of Justice (NIJ) ballistic levels. Ballistic masses are confined to bullets, or bullet sized projectiles. To determine if a polycarbonate shield will resist a larger mass at a lower velocity, testing must occur.

A successful heat exchanger pressure test shield should accomplish two goals; most importantly, it must stop the tube plug upon impact. In addition, it should stop the tube plug with minimal movement, as the observer will be looking through the shield, and a large deflection could cause the shield material itself to hit the observer.

SUMMARY OF THE INVENTION

The present invention, as embodied and broadly described herein, is a transparent, circular, shield, comprised of high impact resistant polycarbonate clamped between two annular metal rings. The polycarbonate shield is isolated from the metal rings with a flexible gasket, allowing some movement when impacted. The polycarbonate shield is held in the center of the metal annular rings by plastic spacers, which surround the polycarbonate shield, and provide the clamping support required for shield assembly.

It is an object of this invention to provide a safe, transparent shield, which can be simply attached to the end flange of a shell and tube heat exchanger, and, can withstand the impact from a tube plug ejected from a tube under pressure.

It is another object of the invention to provide a shield that can be attached to a range of heat exchanger flange diameters, reducing the overall number of total shields required at a single facility.

Additional objects, advantages, and novel features of the invention will become apparent to those skilled in the art upon examination of the following description or may be learned by practice of the invention. The objects and advantages of the invention may be realized and attained as particularly pointed out in the appended claims.

BRIEF DESCRIPTION OF THE DRAWINGS

The accompanying drawings, which are incorporated in and form part of the specification, illustrate an embodiment of the present invention and, together with the description, serve to explain the principles of the invention.

FIG. 1 shows a front view of a heat exchanger pressure test shield according to this invention.

FIG. 2 shows a side view of the heat exchanger pressure test shield according to this invention.

FIGS. 3 and 4 show detail views of the invention with the front annular ring removed, to illustrate the location of the shield material surrounded by the spacers.

DETAILED DESCRIPTION OF THE INVENTION

In accordance with the best mode of this invention, FIG. 1 shows a front view of the assembled heat exchanger pressure test shield which includes the polycarbonate shielding material 11, clamped between a rear and front annular metal ring 10. The clamping means is obtained through the use of through flat head bolts, countersunk on the rear annular ring, passing through the assembly at spaced locations 13, and secured with locknuts on the front annular ring. The assembled heat exchanger pressure test shield is then attached to the heat exchanger undergoing pressure testing by removing the channel cover on the heat exchanger, then replacing with the shield and mounting with (4)—¾" diameter studs to the heat exchanger channel cover flange at slot locations 12.

FIG. 2 is a side view of the heat exchanger pressure test shield, illustrating the front and rear metal annular rings 10, and the polycarbonate shielding material 11 clamped between.

FIGS. 3 and 4 show the front view of large diameter and small diameter, respectively, heat exchanger pressure test shields, with the front metal annular ring removed to show placement of the spacers 14 surrounding the polycarbonate shielding material 11. The holes 13 in the spacers correspond to the holes 13 in the metal annular rings.

Both the front and the rear metal annular rings 10 are 0.375" thick and fabricated out of either A36 Steel or Type 6061-T6 Aluminum, as both materials have similar impact resistant properties. The spacers 14 are 2.0" thick and fabricated out of high density polyethylene. The polycarbonate shielding material is fabricated out of 1.25" thick polycarbonate laminate, such as Makrolon BR1250, by Sheffield Plastics. 0.5" thick×0.75" wide neoprene gasket material is applied around the perimeter of the polycarbonate shielding, on both the front and rear surfaces, prior to placement within the confines of the spacers. When the assembly is clamped together with either 16 bolts, as in FIG. 3, for the large diameter shields, or 8 bolts, as in FIG. 4, for the small diameter shields, the 2-0.5" thick neoprene gaskets are compressed by a total of 0.25" to hold the 1.25" thick polycarbonate shielding material tightly within the 2.0" thick space defined by the spacers. This allows the polycarbonate shielding material to be captured between the two metal annular rings with a flexible gasket interface, which allows the shielding material to move slightly upon impact, which is required for the proper impact performance of polycarbonate. There is a ⅛" gap between the polycarbonate shielding and the spacers on all 4 edges to allow for expansion and contraction of the polycarbonate shielding during changes in temperature.

There are a total of 10 heat exchanger pressure test shields in a complete set. The complete set can be used to shield any diameter heat exchanger from 6 inches to 8 feet. The 5 small diameter shields are between 9.5" in diameter and 2'-8" in diameter. The 5 large diameter shields are between 3'-5" in diameter and 8'-4" in diameter. The mounting slots 12, shown in FIGS. 1 and 4, allow for the mounting of each shield size on a range of heat exchanger channel cover flange diameters, thus allowing a complete set of 10 shields to be used on any diameter heat changer from 6 inches to 8 feet.

Tests were performed using an air gun to shoot a 1" diameter×1.75" long steel tube plug at 170 ft/s to impact various locations on the shield material. This weight and speed corresponds to the maximum tube plug velocity, with a 1.5 safety factor, that is predicted to eject from a heat exchanger tube when pressurized to 4000 psi, which is typically the maximum desired pressure for shell and tube heat exchanger tube plug pressure testing.

The particular sizes and testing parameters discussed above are cited merely to illustrate a particular protection level of this invention. It is contemplated that the use of the invention may involve components having different sizes and thicknesses, and be tested at a higher velocity, should an increased test pressure be desired.

What is claimed is:

1. A heat exchanger pressure test shield, comprising:

a sheet of impact resistant material, said sheet having a thickness and a perimeter consisting of a plurality of straight edges; two annular rings, said rings having a thickness, clamping said sheet, centered in the rings.

2. A heat exchanger pressure test shield according to claim 1, wherein said sheet is square.

3. A heat exchanger pressure test shield according to claim 1, wherein said sheet is transparent.

4. A heat exchanger pressure test shield according to claim 1, wherein said annular rings are metal.

5. A heat exchanger pressure test shield according to claim 1, wherein said shield can be mounted to a shell and tube heat exchanger channel cover flange, replacing the channel cover, with several bolts.

6. A heat exchanger pressure test shield according to claim 1, wherein said shield will resist a 1.0 inch diameter by 1.75 inch long steel projectile, released from a heat exchanger tube, pressurized to 4000 psi.

7. A heat exchanger pressure test shield, comprising:

a sheet of impact resistant material, made of polycarbonate, said sheet having a thickness and a perimeter consisting of a plurality of straight edges; two metal annular rings, said rings having a thickness, clamping said sheet, centered in the rings; plastic spacers, having a thickness greater than said sheet, to center the sheet in the rings; and a flexible gasket separating each ring from said sheet, having a combined thickness of said spacer minus said sheet.

8. A heat exchanger pressure test shield according to claim 7, wherein a set of 10 different diameter shields are mountable to a range of heat exchangers from 6 inches in diameter to 8 feet in diameter.

9. A heat exchanger pressure test shield according to claim 7, wherein the clamping is provided by flat head bolts, passing through the entire assembly, secured by nuts.

10. A heat exchanger pressure test shield according to claim 7, wherein the rear metal annular ring flat head bolts are countersunk, flush with the surface, allowing for mounting to a heat exchanger channel cover flange without interference.

11. A heat exchanger pressure test shield according to claim 7, wherein the flexible gasket is fabricated out of sponge rubber, to provide a flexible interface between the metal annular rings and the impact resistant sheet.

12. A heat exchanger pressure test shield according to claim 11, wherein the flexible gasket is fabricated out of neoprene sponge rubber, to prevent an adverse chemical reaction to impact resistant sheet.

13. A heat exchanger pressure test shield according to claim 11, wherein the flexible gasket has an adhesive on one side to secure it to the impact resistant sheet.

14. A heat exchanger pressure test shield according to claim 11, wherein the flexible gasket is 0.25" thicker than the spacer thickness minus the impact resistant sheet thickness divided by two, to provide a slight compression upon assembly.

15. A heat exchanger pressure test shield according to claim 7, wherein the spacers, when assembled to the metal annular rings, create a square sheet capture area that is 0.125" longer and wider, to allow for impact resistant sheet temperature expansion and contraction.

16. A heat exchanger pressure test shield according to claim 15, wherein the spacers, are high density polyethylene plastic (HDPE).

17. A heat exchanger pressure test shield according to claim 7, wherein the metal annular rings are aluminum.

18. A heat exchanger pressure test shield according to claim 7, wherein the metal annular rings are steel.

19. A heat exchanger pressure test shield according to claim 7, wherein 2 swivel hoist rings are attached to assist lifting.

20. A heat exchanger pressure test shield according to claim 7, wherein said shield will resist a 1.0 inch diameter by 1.75 inch long steel projectile, released from a heat exchanger tube, pressurized to 4000 psi.

* * * * *